US010576652B2

(12) United States Patent
Wierzchon

(10) Patent No.: US 10,576,652 B2
(45) Date of Patent: Mar. 3, 2020

(54) ARTICULATING OSCILLATING POWER TOOL

(71) Applicants: Robert Bosch Tool Corporation, Broadview, IL (US); Robert Bosch GmbH, Stuttgart (DE)

(72) Inventor: Peter J. Wierzchon, Morton Grove, IL (US)

(73) Assignees: Robert Bosch GmbH, Stuttgart (DE); Robert Bosch Tool Corporation, Broadview, IL (US)

( * ) Notice: Subject to any disclaimer, the term of this patent is extended or adjusted under 35 U.S.C. 154(b) by 0 days.

(21) Appl. No.: 14/516,933

(22) Filed: Oct. 17, 2014

(65) Prior Publication Data

US 2015/0135541 A1 May 21, 2015

Related U.S. Application Data

(60) Provisional application No. 61/904,503, filed on Nov. 15, 2013.

(51) Int. Cl.
*B27B 19/00* (2006.01)
*B25F 5/00* (2006.01)

(52) U.S. Cl.
CPC ..... *B27B 19/006* (2013.01); *B25F 5/006* (2013.01); *Y10T 279/3412* (2015.01)

(58) Field of Classification Search
CPC ..... B27B 19/006; B27B 19/008; B25F 5/006; B25F 5/001; Y10T 279/3412; A61B 17/14
USPC ..... 30/276, 392, 393, 208, 209, 211
See application file for complete search history.

(56) References Cited

U.S. PATENT DOCUMENTS

| | | | | |
|---|---|---|---|---|
| 436,804 | A | 9/1890 | Roberts | |
| 3,554,197 | A * | 1/1971 | Dobbie | A61B 17/14 30/392 |
| 4,106,181 | A * | 8/1978 | Mattchen | A61B 17/14 279/77 |
| 5,237,884 | A * | 8/1993 | Seto | B27B 19/006 30/166.3 |
| 5,363,711 | A | 11/1994 | Seto | |
| 5,729,904 | A * | 3/1998 | Trott | B23D 51/10 30/339 |
| 5,832,611 | A * | 11/1998 | Schmitz | B23D 49/11 30/392 |
| 6,871,405 | B2 * | 3/2005 | Reale | B23D 51/10 30/277.4 |
| 8,387,717 | B2 * | 3/2013 | Kildevaeld | B23D 51/10 173/1 |
| 2005/0192585 | A1 * | 9/2005 | Simmons | A61B 17/14 606/82 |

(Continued)

OTHER PUBLICATIONS

International Search Report and Written Opinion corresponding to PCT Application No. PCT/US2014/074105 (10 pages).

*Primary Examiner* — Phong H Nguyen
(74) *Attorney, Agent, or Firm* — Maginot, Moore & Beck LLP

(57) ABSTRACT

An oscillating power tool includes a drive motor producing rotary motion and an actuator for converting the motor rotary motion to an oscillatory side-to-side movement. The power tool includes a tool mount operably driven by the actuator and configured to support the tool so that the working end is substantially collinear and/or coplanar with the axis of the motor drive shaft.

12 Claims, 5 Drawing Sheets

(56) References Cited

U.S. PATENT DOCUMENTS

| | | | | |
|---|---|---|---|---|
| 2005/0245935 | A1* | 11/2005 | Casey | A61B 17/142 606/82 |
| 2006/0137498 | A1* | 6/2006 | Bowling | B23D 49/11 83/13 |
| 2011/0209888 | A1* | 9/2011 | Elsworthy | B23B 31/1071 173/217 |
| 2013/0181414 | A1* | 7/2013 | Haman | B27B 19/006 279/144 |
| 2014/0068952 | A1* | 3/2014 | Soreo | B27B 19/008 30/369 |

* cited by examiner

ARTICULATING OSCILLATING POWER TOOL

REFERENCE TO RELATED APPLICATION AND PRIORITY CLAIM

This application is a utility application of and claims priority to provisional application No. 61/904,503, filed on Nov. 15, 2013, the entire disclosure of which is incorporated herein by reference.

FIELD

This disclosure relates to the field of power tools, and more particularly to a handheld power tool having an oscillating tool which can be articulated through a range of positions including zero to ninety degrees.

BACKGROUND

Oscillating power tools are lightweight, handheld tools configured to oscillate various accessory tools and attachments, such as cutting blades, sanding discs, grinding tools, and many others. The accessory tools and attachments can enable the oscillating power tool to shape and contour workpieces in a many different ways. Previously known oscillating tools, however, are limited in their ability to perform certain tasks in work areas that are difficult to access. These oscillating power tools have fixed tool heads which can limit the number of tasks that can be performed. Oscillating power tools with fixed tool heads can also cause the operator to locate the tool in less convenient positions when performing work. Sometimes the position of the power tool necessitated by the nature of the workpiece can be inadequate to effectively complete a task. The operator may be forced to either select another tool to complete the task, or resort to non-powered tools, both of which can increase the amount of time to complete a task as well as reduce the amount of time the operator can work on the workpiece due to fatigue.

For example, while different types of accessory tools are available to perform cutting, scraping, and sanding operations, the use of such accessory tools is limited in an oscillating power tool where the tool head is fixed with respect to the tool, the tool body or tool handle. The range of uses for these accessory tools, consequently, can be rather narrow, since the output orientation of the oscillating tool head is fixed according to the position of the power tool, the tool body or tool handle. For example, a flush cutting blade accessory for an oscillating power tool can be used to trim or shave thin layers of material from the surface of a workpiece. Because this type of accessory can present a risk that the blade can gouge the surface and possibly ruin the workpiece, orientation of the tool head is important and made more difficult in power tools with fixed tool heads.

There is a need for a handheld power tool with an oscillating tool or blade that can be operated ergonomically to reduce operator fatigue, but that is suitable for optimally performing a wide range of cutting operations.

SUMMARY OF THE DISCLOSURE

In one aspect, an oscillating power tool comprises a housing; a motor located in the housing and having a drive shaft configured for rotation about a first axis; an actuator operatively coupled to the drive shaft and configured to convert the rotation of the drive shaft to an oscillatory displacement in a plane; a tool holder coupled to the actuator and configured to move in response to movement of the actuator, wherein the tool holder is configured to support the tool with its working surface substantially collinear with the longitudinal axis of the motor drive shaft.

The disclosure further contemplates a tool having a working surface defining a plane, such as a cantilevered blade for performing plunge cuts. The actuator is configured to support the cantilevered blade so that the plane of the blade working surface is at least parallel or nearly parallel to and preferably coplanar or nearly coplanar with the plane of oscillatory displacement produced by the actuator. In one aspect, the tool may configured with the blade fixed in the collinear/near collinear or coplanar/near coplanar vibration reducing position, or may be configured to permit movement or articulation of the cutting blade or accessory to and from positions in which the vibration is reduced from a maximum vibration orientation, and to and from a position in which the vibration is at a minimum.

DETAILED DESCRIPTION

Figure 1:
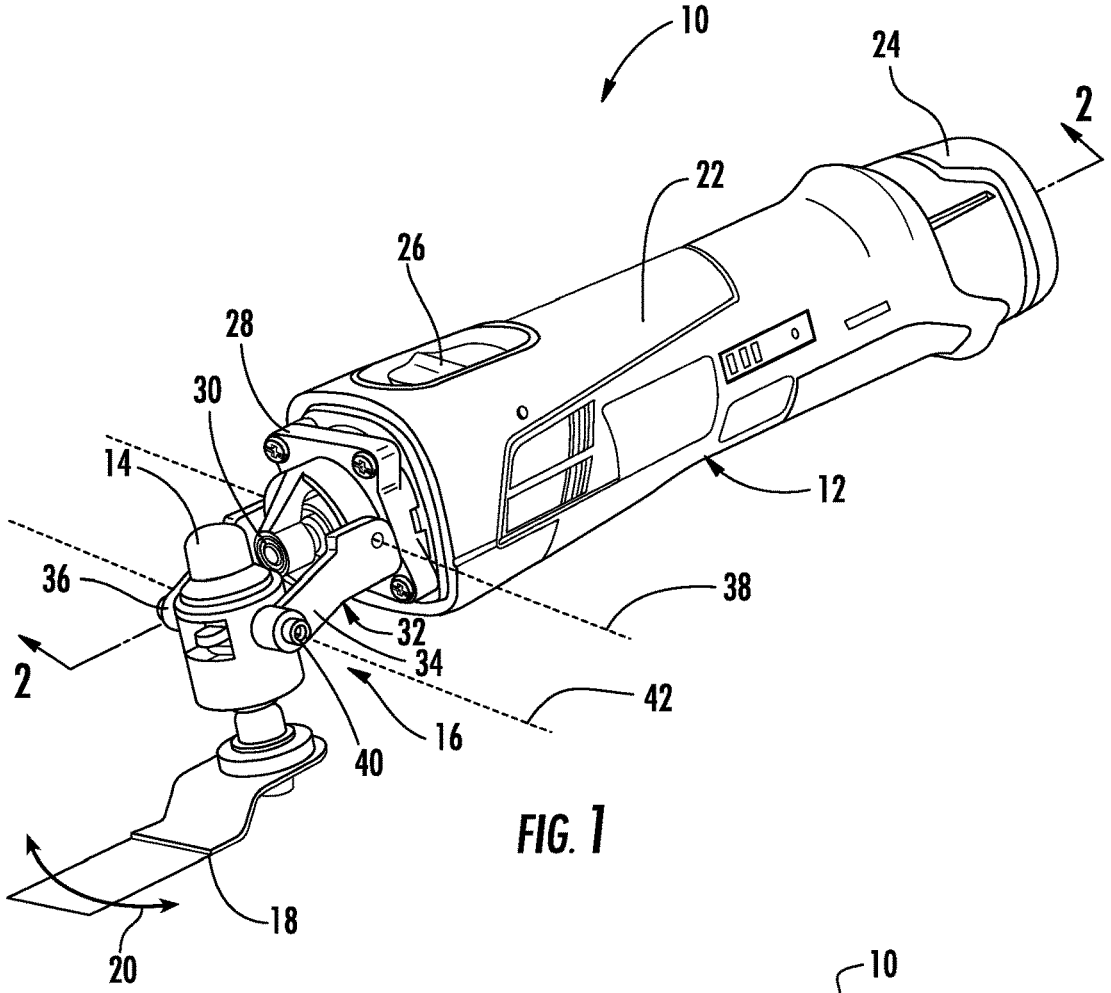
FIG. 1 is a perspective view of an oscillating power tool including an articulating tool holder.

For the purposes of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

FIG. 1 illustrates an oscillating power tool 10 having a generally cylindrically shaped housing 12 with a tool holder 14, or tool head, located at a front end 16 of the tool 10. The tool holder 14 is adapted to accept a number of different tools or tool accessories, one of which is illustrated as a scraping tool 18. The scraping tool 18 oscillates from side to side or in a reversing angular displacement along the direction 20. Other oscillating accessory tools are known and include those having different sizes, types, and functions including those performing cutting, scraping, and sanding operations. The housing 12 can be constructed of a rigid material such as plastic, metal, or composite materials such as a fiber reinforced polymer. The housing 12 can include a nose housing (not shown) to cover the front of the tool, the tool head, and related mechanisms.

The housing 12 includes a handle portion 22 which can be formed to provide a gripping area for an operator. A rear portion 24 of the housing can include a battery cover which opens and closes to accept replaceable or rechargeable batteries. The cover can also be part of a replaceable rechargeable battery so that the cover stays attached to the rechargeable battery as part of a battery housing. Housing 12 includes a power switch 26 to apply power to or to remove power from a motor (to be described later) to move the tool 18 in the oscillating direction 20. The power switch 26 can adjust the amount of power provided to the motor to control motor speed and the oscillating speed of the tool 18. In one embodiment, the motor comprises an electric motor configured to receive power from a battery or fuel cell. In other embodiments, electric power to the motor may be received from an AC outlet via a power cord (not shown). As an alternative to electric power, the oscillating power tool 10 may be pneumatically driven, fuel powered, such as gas or diesel, or hydraulically powered. The tool can also include another user input such as a second switch separately from the power switch 26 for controlling the motor speed.

The front end 16 of the tool 10 includes a drive shaft support 28 which receives a drive shaft coupled to the motor, an end portion 30 of which is supported for rotation within the support 28. An articulator 32 includes an articulating support having a first articulation arm 34 and a second articulation arm 36, each having a first end pivotally coupled to the drive shaft support 28 at an axis of rotation 38. A second end of the arms 34 and 36 are coupled to the tool holder 14 by respective bolts 40. Each of the bolts 40 can fix the arms 34 and 36 to the tool holder 14 such that rotation of the tool holder 14 does not occur at the location of the bolts 40. The interface between the arms 34 and 36 and the tool holder can, however, be configured to allow rotational movement of the tool holder around an axis 42 to provide an additional location of tool head adjustment.

Figure 2:
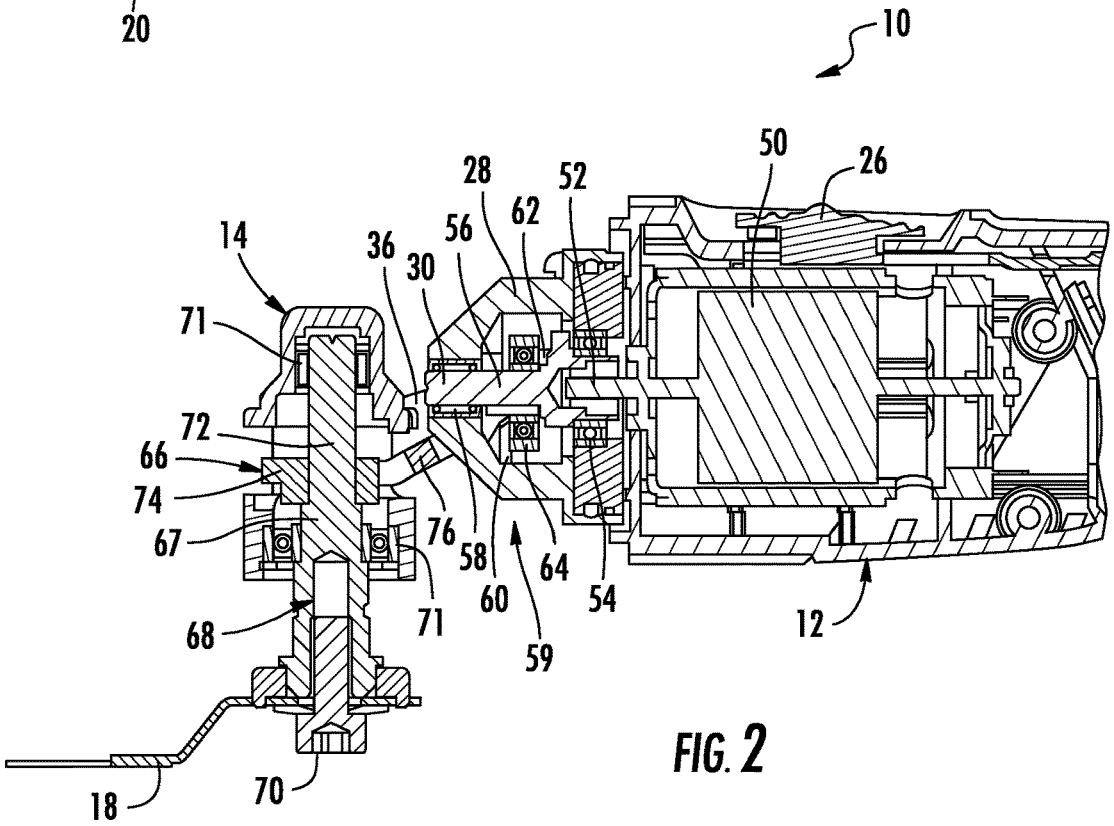
FIG. 2 is a sectional elevational side view of the tool of FIG. 1 taken along a line 2-2 and viewed in the direction of the arrow.

FIG. 2 is a sectional elevational side view of a portion of the tool of FIG. 1 taken along a line 2-2 and viewed in the direction of the arrows. The tool 10 supports a motor 50 including a drive shaft 52 within the housing 12. The shaft 52 of the motor 50 is generally aligned along a longitudinal axis of the housing 12 and is supported for rotation within a bearing 54. At the terminating end of the drive shaft 52, an eccentric drive shaft 56 is mounted having the portion 30 of the eccentric drive shaft mounted for rotation within a support housing bearing 58. The eccentric drive shaft 56 includes a central portion to which an eccentric drive bearing 60 of an actuator 59 is mounted. The actuator 59 is configured to convert the rotary output of the motor drive shaft to oscillating side-to-side movement. The eccentric drive bearing includes an inner ring 62 fixedly mounted to the eccentric drive shaft 56 and an outer ring 64 rotatably mounted about the inner ring 62. A plurality of rolling element bearings is located between the inner ring and outer ring to complete the bearing. Ball bearings or cylinder bearings can be used accordingly.

Because the inner ring 62 is fixed to the eccentric drive shaft, the surface of the inner ring follows an eccentric path which in turn causes an outer surface of the outer ring 64 to move along an eccentric path. A link 66 is operatively coupled to the outer ring 64 and to a tool mount 67 located within the tool holder 14. The tool mount 67 is generally a cylindrically shaped shaft and extends from a bottom portion of the tool holder 14 and includes a recess 68 adapted to accept the tool 18 in a fixed position with respect to the tool mount 67. Other shapes of the tool mount are possible. The tool 18 can be fixedly mounted to the tool mount 67 by a bolt 70 extending into the tool 18 and the recess 68. The tool holder 14 and/or tool mount 67 can be formed to include a friction fit interface between the tool 18 and the recess 68 to provide a fixed mounting location for the tool without the need for a bolt or other fastener. Bearings 71, operatively coupled to the tool mount 67, provide for rotational movement of the tool mount 67 within the tool holder 14.

A mounting portion 72 of the tool mount 67 is formed to accept an end 74, also called a central portion, of the link 66 such that the end 74 is held in a fixed position with respect to the mount 67. The mounting portion 72 can include a key which mates with a corresponding mating feature formed in the end 74 the link 66.

Figure 3:
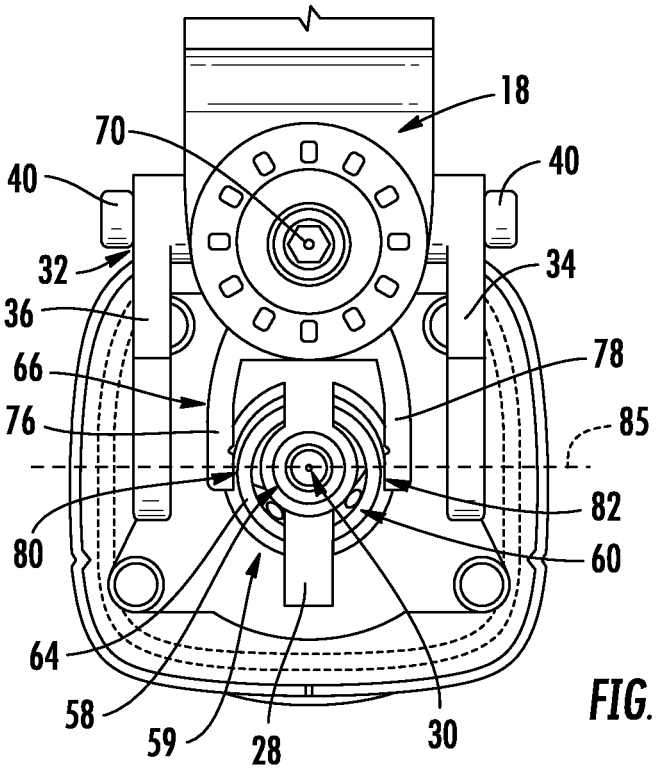
FIG. 3 is a front view of the nose portion of the power tool of FIG. 1 with articulating arms located at ninety (90) degrees with respect to a longitudinal axis of the tool.

As further illustrated in FIG. 3, the link 66 is operatively coupled to and actuated by the outer ring 64 to move in response to the rotation of the drive shaft 52 and the inner ring 62. The end 74 (as shown in FIG. 2) therefore actuates the tool 18 bi-directionally in the direction 20 of FIG. 1. In one embodiment of the disclosure, the link 66 includes a first branch 76 and a second branch 78 coupled to the end 74. Each of the first branch 76 and second branch 78 include respective terminating ends. The first branch 76 includes, at the terminating end, a contacting surface 80 and the second branch 78 includes, at the terminating end, a contacting surface 82. The terminating ends extend at right angles from the branches, but other configurations are possible. Each of the contacting surfaces 80 and 82 are positioned adjacent to the outer ring 64 and can be spaced from the outer surface of the outer ring 64 depending on the positions of the contacting surfaces 80 and 82 and the outer ring. The link and the central portion maintain the location of the contacting surfaces 80 and 82 at the outer surface of the outer ring 64. By providing a first branch and a second branch having open ends, a fork is formed.

During continuous rotation of the drive shaft 52, the eccentric drive shaft 56 moves the inner ring 62 eccentrically and continuously about the longitudinal axis of the tool 10 which forces the outer surface of outer ring 64 to move eccentrically as well. The outer ring does not typically rotate continuously but moves intermittently. This eccentric motion is transferred to the contacting surfaces 80 and 82, which are each spaced a predetermined distance from the outer surface of the outer ring 64 during at least part of the rotation of the eccentric drive shaft. Intermittent contact occurs between the outer surface of the outer ring and at least one of contacting surfaces 80 and 82 during operation. Consequently, the terminating ends of the first branch 76 and the second branch 78 oscillate generally from side to side along a line 85 due to the eccentric movement of the outer ring 64. In one embodiment, the spacing between a contacting surface 80 or 82 and the outer surface of the outer ring 64 can range from about 0.05 to 0.1 mil. As the inner ring 62 rotates continuously, the outer surface of the outer ring 64 moves generally continuously with the inner ring 62.

In FIG. 3, the line 85 also represents a pivot axis about which the ends of the branches 76 and 78 rotate when the tool head 14 is articulated. In this embodiment, therefore, the axis of rotation 38 and the axis of rotation at the line 85 are co-linear. In other embodiments, the axis of rotation of the articulating arms and the direction of oscillation of the link are not co-linear.

Side to side motion of the outer surface of the outer ring 64 is harnessed by the contacting surfaces 80 and 82 to cause the first branch 76 and the second branch 78 to move generally side to side along the line 85 which in turn moves the tool 18 in repeating and reversing arcs of movement. Because the outer surface of the outer ring 64 moves eccentrically, the point of contact at the contacting surfaces 80 and 82 varies at the surfaces and is not fixed exactly at the line 85. The linear motion of each branch, however, while limited to the eccentricity of the outer ring, is sufficient to move the branches and the end 74 which causes the tool mount 67 to turn about the axis thereof in a reversing angular direction. Consequently, the tool mount 67 does not move in complete rotations about an axis. The tool 18 responds accordingly in an oscillating fashion to provide the desired function, including sanding, grinding, cutting, buffing, or scraping.

As previously described with respect to FIG. 1, the first articulation arm 34 and the second articulation arm 36 are coupled to the support 28 and move in an arc about the axis 38. In the illustrated embodiment, this axis of rotation 38 coincides in at least one plane with the line 85 as illustrated in FIG. 3. Because the arms 34 and 36 rotate about the axis 38 and the link 66 is coupled to the tool head 14, the contacting surface 80 of the first branch 76 and the contacting surface 82 of the second branch 78 also generally rotate about the axis 38. Consequently, the first branch 76 and second branch 78 are maintained at the predefined pivot axis due to the location of the pivot axis 38, the location of the arms 34 and 36, and the location of the drive bearing 60. Side to side movement of the first branch 76 and second branch 78 therefore generally occurs along the line 85 during positioning of the tool holder 14 throughout the tool holder range of motion.

Figure 4:
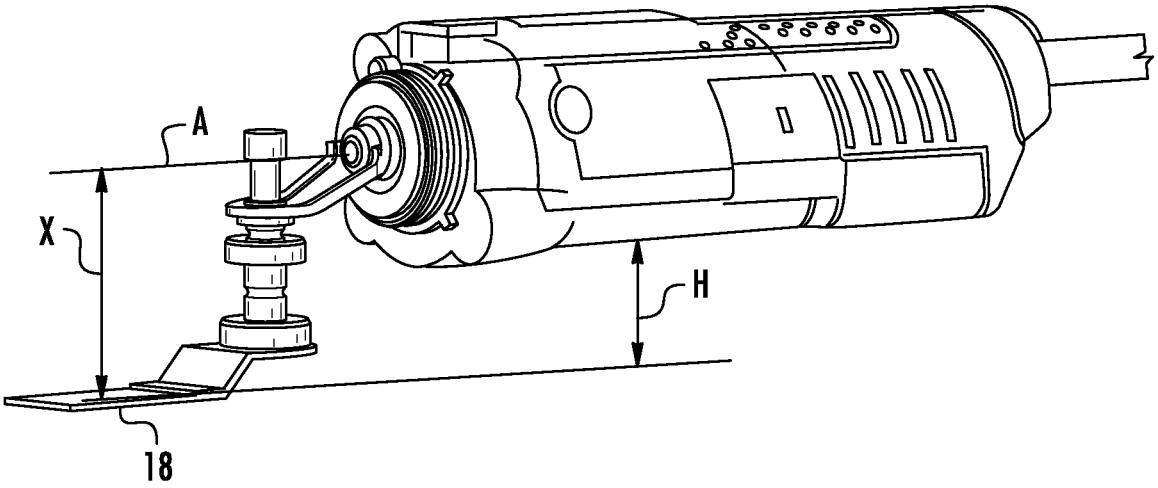
FIG. 4 is a perspective view of the power tool shown in FIG. 1 identifying one source of vibration during operation of the power tool.
Figure 5:
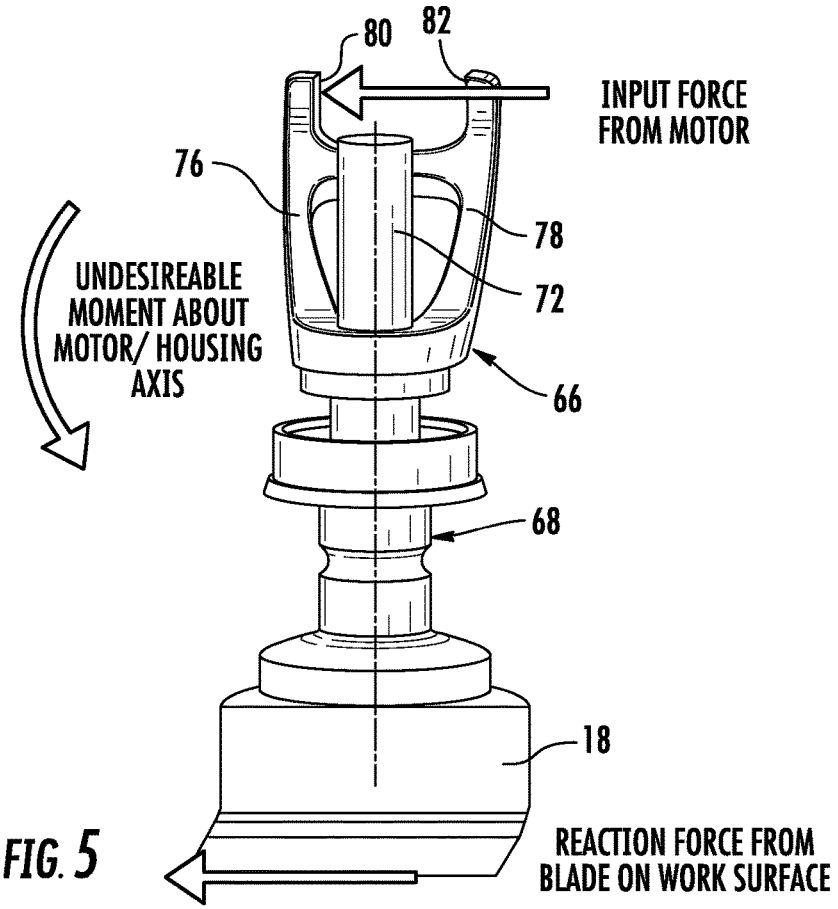
FIG. 5 is a front view of the blade and actuator components of the power tool shown in FIG. 1 identifying an additional source of vibration during operation of the power tool.

The handheld oscillating tool 10 of FIGS. 1-3 provides significant benefits to the operator such as providing access to areas that are otherwise inaccessible or difficult to access. For instance, as depicted in FIG. 4, the cutting blade 18 is offset by a distance X from the longitudinal axis or motor axis A of the tool. This feature can provide hand clearance H for uses in which the cutting blade 18 is flush with the work surface. The performance of the tool, as illustrated in FIG. 5, may be enhanced by minimizing or eliminating any undesirable moment being applied about the motor axis A caused by the reaction force of the high speed oscillation of the blade on the work surface as well as the inertial loading of the user-installed accessory.

Figure 6:
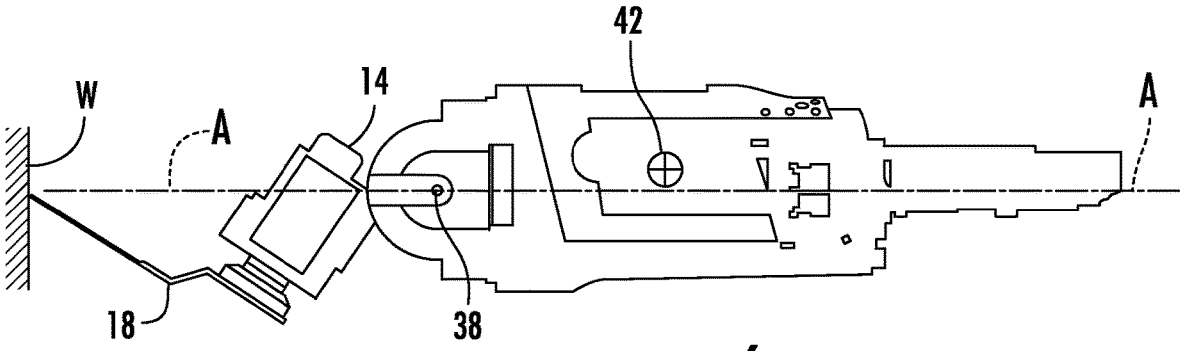
FIG. 6 is a side partial cut-away view of the power tool shown in FIG. 1 shown with the working tool at an articulation angle.
Figure 7:
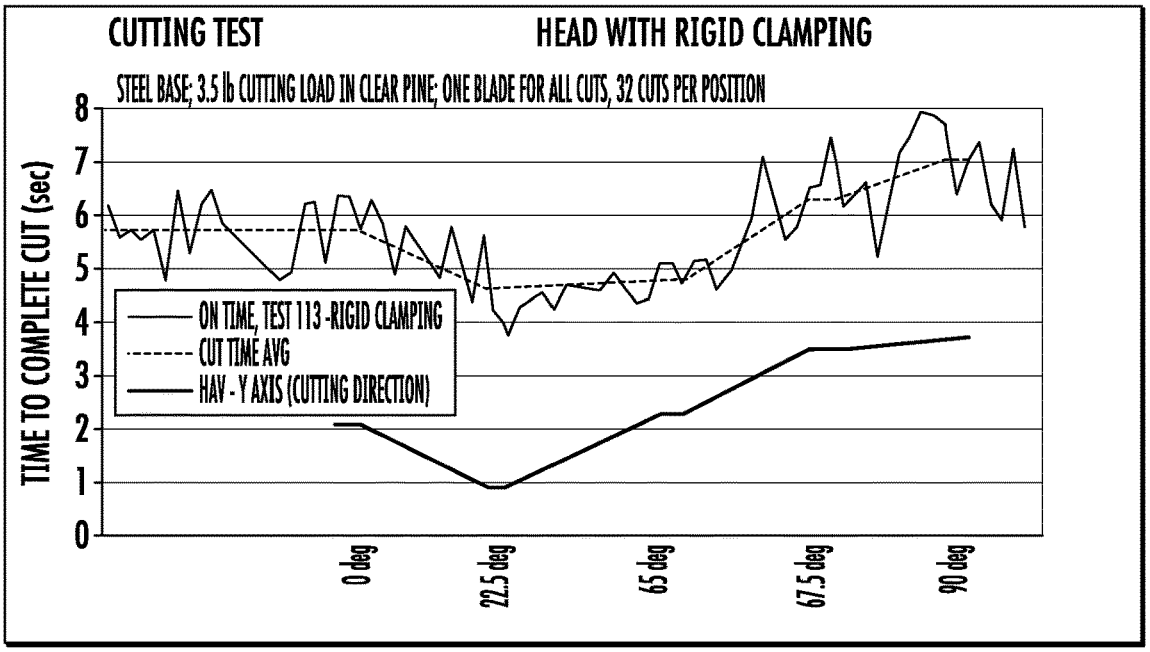
FIG. 7 is a graph of cutting speed as a function of articulation angle for the power tool shown in FIG. 1.
Figure 8:
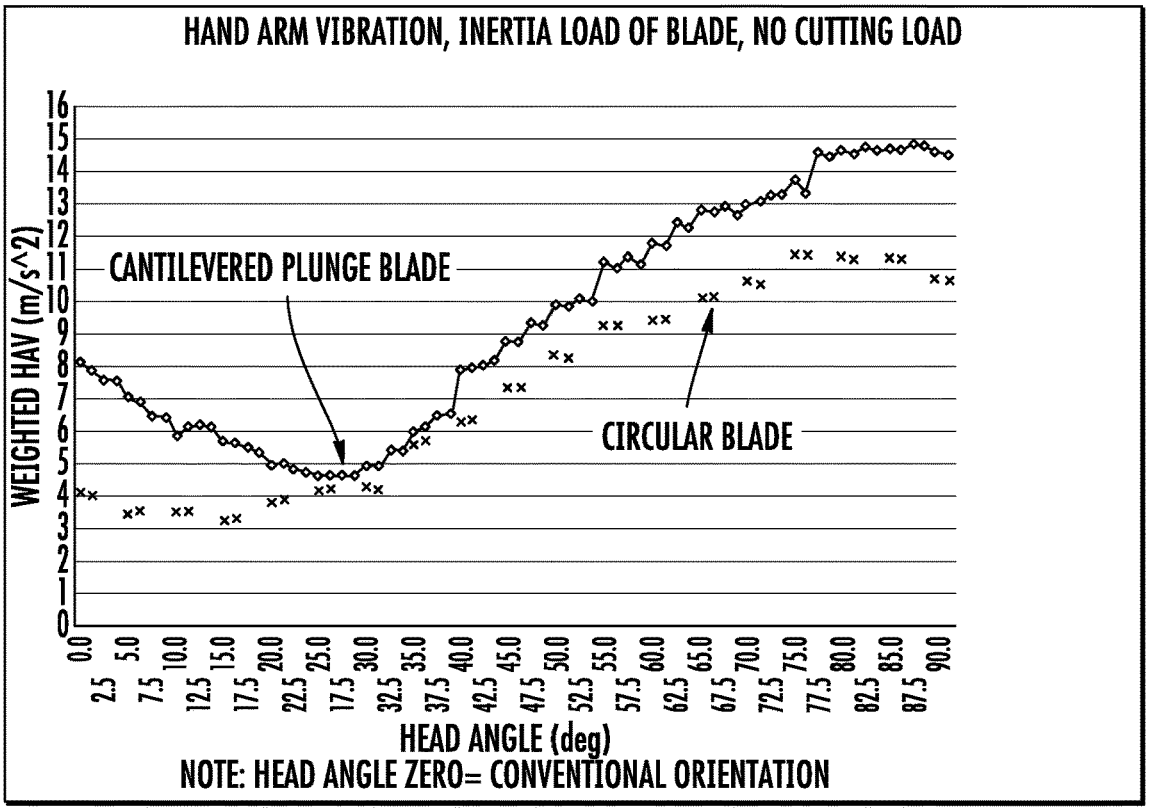
FIG. 8 is a graph of vibration magnitude as a function of articulation angle for the power tool shown in FIG. 1 and for a power tool having a cantilevered plunge blade.

FIG. 6 illustrates an exemplary tool device 10 with an accessory tool 18 at an angular offset position. When the interface of the cutting tool 18 with the work surface W is along the motor axis A the center of gravity 42 of the cutting tool and tool holder 14 results in a reduced undesirable moment. This reduced moment manifests in decreased vibration of the tool housing and in a variable inertial load on the drive mechanism. The angular offset increases the working performance of the tool or blade, as demonstrated by the decrease in cutting times depicted in the graph of FIG. 7. Moreover, less vibration is transmitted through the housing to the operator's hand, reducing operator fatigue and discomfort. The graph of FIG. 8 illustrates the vibration levels for both a cantilevered plunge blade (such as the blade 18 of FIG. 1) and a circular blade. It can be seen that even with a circular blade, in which the tool center of gravity is more closely aligned with the axis of the tool mount 72 than for the plunge blade, the vibration levels are reduced significantly when the cutting tool 18 is aligned with the center of gravity of the power tool, as shown in FIG. 6. The vibration levels of the oscillating power tool 10, as illustrated in FIGS. 1-3, is represented by a zero degree head angle on the graph of FIG. 8.

Figure 9:
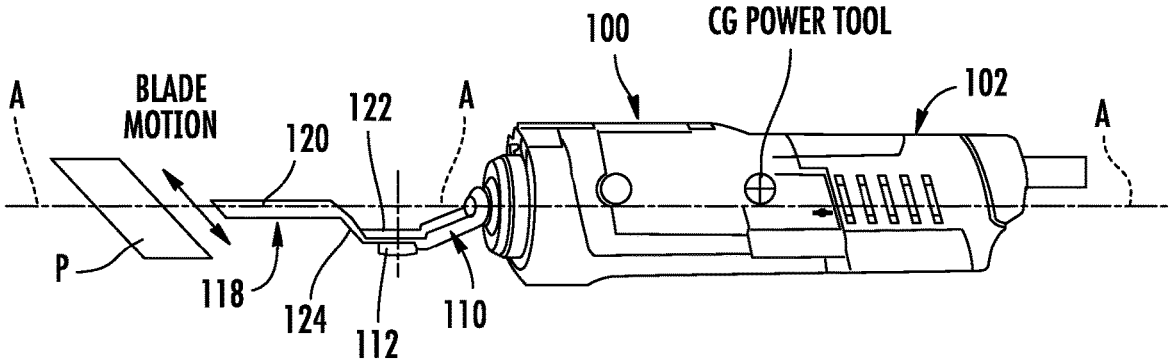
FIG. 9 is a side view of a power tool according to one aspect of the disclosure.
Figure 10:
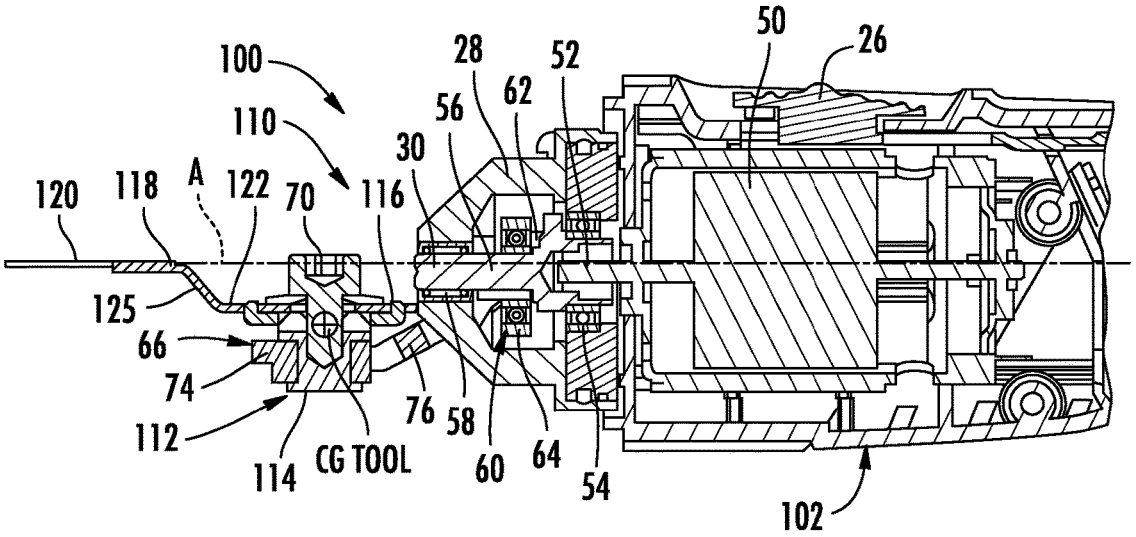
FIG. 10 is a side partial cross-section view of the power tool shown in FIG. 9.

In order to eliminate or minimize the vibration caused by the eccentric oscillation of the blade, an oscillating tool 100 is provided in which the plane of the blade working surface is generally coplanar and collinear with the axis A of the drive motor, as illustrated in FIGS. 9-10. The tool 100 includes a housing 102 similar to the housing 12 that houses the rotary drive motor, which is similar to the drive motor 50, with the output shaft of the motor aligned along the axis A. The output shaft of the motor is operably coupled to an actuator 110 that can be constructed similar to the articulator 32 to convert rotary motion of the motor to a side-to-side oscillatory motion.

A blade or working tool 118 is mounted to the actuator 110 so that the side-to-side motion of the actuator is conveyed to the blade. As shown in FIG. 9, the working end 120 of the blade is substantially coplanar and collinear with the motor axis A so that the working end oscillates within the plane P defined by the blade, as indicated by the blade motion arrows. The plane P is oriented to coincide with a transverse plane defined by the actuator 110 so that there is no offset between the plane of oscillation of the actuator 110 and the plane of oscillation of the blade 118. The blade 118 includes a mounting end 122 that is engaged to a tool mount 112 of the actuator 110, and a transition portion 124 that spans the offset between the tool mount and the motor axis A or plane P. This configuration thus substantially aligns the cutting loads, or reaction force from the blade engaging the work surface, with the plane of the highest moment of inertia component of the tool 100, namely the housing 102 and motor assembly within. The configuration depicted in FIG. 9 thus results in more of the motor energy being transmitted to oscillating the blade 118 and reduces the amount of motor energy absorbed in wasteful vibration of the tool. The decreased vibration also provides a benefit to the operator of reduced hand fatigue.

In one embodiment the blade 118 is mounted to the actuator 112 in a manner similar to the tool of FIG. 2. As shown in the cross-sectional view of FIG. 10, the tool 100 may include similar components within the housing 102 and in the actuator 112. However, in this embodiment the blade 118 is oriented so that the working end 120 is coplanar with the motor axis A. Thus, the blade 118 is mounted to the end 74 of the link 66 so that the blade is above the link, rather than below as in the tool 10. The blade 118 is also mounted to the end of the link 66 so that the working surface 120 of the blade is above the center of gravity $CG_{tool}$ of the tool. This arrangement minimizes the undesirable moment about the housing that occurs in prior power tools.

The actuator 112 thus includes a tool mount 114 that passes through the bore in the link end 74 and which includes a threaded bore for receiving the bolt 70. A locking plate 116 may be sandwiched between the mounting portion 122 of the blade 118 and the link 66. The blade is thus mounted so that the working surface 120 is aligned with the axis A and so that the blade oscillates from side-to-side with the link 66 of the actuator 112. It can be appreciated that the actuator 112 may be configured for a fixed angular orientation of the blade 118, particularly the orientation shown in FIG. 6. Alternatively, the actuator 112 may be integrated with an articulator, such as the articulator 32 of the tool 10, to permit vertical angular adjustment of the blade perpendicular to the plane P in the manner described above for the tool 10. While modifying the angular orientation of the blade inherently introduces some offset vibration effect, since the center of gravity of the articulator and blade assembly is closer to the center of gravity of the tool, the effect is minimized, in particular by creating a collinear alignment of the working end of the blade 18 with the motor axis A as illustrated in FIG. 6.

It can be appreciated that the blade arrangement shown in FIGS. 9 and 10 may provide an optimum alignment of the cutting blade with the motor axis that leads to a significant reduction in vibration due to oscillation of the blade and inertial loading. However, this arrangement inhibits the ability to make flush cuts with the cantilevered plunge blade. On the other hand, the blade arrangement shown in FIG. 6 allows the user to make flush cuts since adequate hand clearance is present in an angled but fixed head configuration. In an adjustable articulating configuration, the blade can be pivoted to a perpendicular or near-perpendicular angle relative to the tool housing 12. While the vibration effects are higher at the perpendicular angles, the vibration reduction is significant at the near coplanar or collinear orientation of the blade depicted. An adjustable articulating configuration, such as shown in FIG. 6, allows the user to adjust the orientation of the cutting accessory relative to the motor axis A to minimize vibration and maximize cutting performance.

The disclosure contemplates a power tool comprising a housing; a motor located in the housing and having a drive shaft configured for rotation about a first axis; an actuator operatively coupled to the drive shaft and configured to convert the rotation of the drive shaft to an oscillatory displacement in a plane; a tool holder coupled to the actuator and configured to move in response to movement of the actuator, wherein the tool holder is configured to support the tool with its working surface substantially collinear with the longitudinal axis of the motor drive shaft. The disclosure further contemplates a tool having a working surface defining a plane, such as a cantilevered blade for performing plunge cuts. The actuator is configured to support the cantilevered blade so that the plane of the blade working surface is at least parallel or nearly parallel to and preferably coplanar or nearly coplanar with the plane of oscillatory displacement produced by the actuator. The tool may configured with the blade fixed in the collinear/near collinear or coplanar/near coplanar vibration reducing position, or may be configured to permit movement or articulation of the cutting blade or accessory to and from positions in which the vibration is reduced from a maximum vibration orientation, and to and from a position in which the vibration is at a minimum.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A power tool comprising:

a housing;

a motor located in the housing and having a drive shaft configured for rotation about a longitudinal axis;

an actuator operatively coupled to the drive shaft and configured to convert the rotation of the drive shaft to an oscillatory displacement in a plane;

a tool holder fixed to the actuator and configured to move in response to movement of the actuator;

a tool supported by the tool holder, the tool having a working surface defining a working surface plane; and an articulator operatively coupled to said housing and said tool holder, said articulator configured to permit adjustment of the tool holder through a range of angles relative to said longitudinal axis, wherein the actuator, tool holder and tool are configured so that the tool is supported by said tool holder with the plane of the tool working surface substantially parallel to and collinear with the longitudinal axis of the motor drive shaft.

2. The articulating power tool of claim 1, wherein:

the tool and actuator are configured so that the tool is supported so that the plane of the working surface is substantially parallel to and substantially coplanar with the oscillatory displacement plane.

3. The articulating power tool of claim 2, wherein the tool is a cantilevered blade for performing plunge cuts.

4. The articulating power tool of claim 1, wherein:

said actuator includes;

an eccentric mechanism coupled to the drive shaft to convert drive shaft rotation to oscillatory displacement; and a link extending from said eccentric mechanism away from said tool housing and below said longitudinal axis; and said tool holder is connected to said link.

5. The articulating power tool of claim 4, wherein:

said link defines a bore therethrough; and said tool holder is engaged within said bore with said working surface above said bore relative to said longitudinal axis.

6. The articulating power tool of claim 5, wherein said tool is engaged to said tool holder by a locking plate disposed between a mounting portion of said tool and said link and a bolt passing through said locking plate and said mounting portion of said tool and in threaded engagement with said tool holder.

7. The articulating power tool of claim 1, wherein said tool includes a mounting portion defining a mounting surface offset from said working surface, said mounting surface supported on said tool holder.

8. A power tool comprising:

a housing;

a motor located in the housing and having a drive shaft configured for rotation about a longitudinal axis;

an actuator operatively coupled to the drive shaft and configured to convert the rotation of the drive shaft to an oscillatory displacement in a plane;

a tool holder fixed to the actuator and configured to move in response to movement of the actuator;

a tool supported by the tool holder, the tool having a working surface defining a working surface plane; and an articulator operatively coupled to said housing and said tool holder, said articulator configured to permit adjustment of the tool holder through a range of angles relative to said longitudinal axis, wherein the power tool defines a center of gravity and a plane extending through said housing and said center of gravity, and wherein the tool holder and tool are configured so that the tool is supported by said tool holder with the tool working surface plane coplanar or co-linear with the plane extending through said center of gravity.

9. The power tool of claim 8, wherein:

said actuator includes;

an eccentric mechanism coupled to the drive shaft to convert drive shaft rotation to oscillatory displacement; and a link extending from said eccentric mechanism away from said tool housing and below said longitudinal axis; and said tool holder is connected to said link.

10. The power tool of claim 9, wherein:

said link defines a bore therethrough; and said tool holder is engaged within said bore with said working surface above said bore relative to said longitudinal axis.

11. The power tool of claim 10, wherein said tool is engaged to said tool holder by a locking plate disposed between a mounting portion of said tool and said link and a bolt passing through said locking plate and said mounting portion of said tool and in threaded engagement with said tool holder.

12. The power tool of claim 8, wherein said tool includes a mounting portion defining a mounting surface offset from said working surface, said mounting surface supported on said tool holder.

* * * * *